US011067077B2

(12) United States Patent
Huang et al.

(10) Patent No.: US 11,067,077 B2
(45) Date of Patent: Jul. 20, 2021

(54) ROTATING CYLINDER ENTHALPY-ADDING PISTON COMPRESSOR AND AIR CONDITIONING SYSTEM HAVING SAME

(71) Applicant: Gree Green Refrigeration Technology Center CO., LTD. of Zhuhai, Zhuhai (CN)

(72) Inventors: Hui Huang, Zhuhai (CN); Yusheng Hu, Zhuhai (CN); Lingchao Kong, Zhuhai (CN); Zhongcheng Du, Zhuhai (CN); Sen Yang, Zhuhai (CN); Jia Xu, Zhuhai (CN); Liping Ren, Zhuhai (CN)

(73) Assignee: Gree Green Refrigeration Technology Center CO., LTD. of Zhuhai, Zhuhai (CN)

( * ) Notice: Subject to any disclaimer, the term of this patent is extended or adjusted under 35 U.S.C. 154(b) by 238 days.

(21) Appl. No.: 16/234,600

(22) Filed: Dec. 28, 2018

(65) Prior Publication Data

US 2019/0249664 A1 Aug. 15, 2019

Related U.S. Application Data

(63) Continuation of application No. PCT/CN2017/073159, filed on Feb. 9, 2017.

(51) Int. Cl.
*F04C 18/02* (2006.01)
*F04C 18/356* (2006.01)
(Continued)

(52) U.S. Cl.
CPC ..... *F04C 18/02* (2013.01); *F04C 18/32* (2013.01); *F04C 18/356* (2013.01); *F04C 23/001* (2013.01); *F04C 29/00* (2013.01)

(58) Field of Classification Search
CPC ..... F04C 18/02; F04C 18/32; F04C 23/001; F04C 18/356; F04C 29/00; F04C 23/008;
(Continued)

(56) References Cited

U.S. PATENT DOCUMENTS 4,006,602 A * 2/1977 Fanberg ..... F04B 39/06 62/113
4,622,828 A * 11/1986 Fujiwara ..... F25B 41/20 62/200
(Continued)

FOREIGN PATENT DOCUMENTS

CN 102042227 A 12/2011
CN 105545737 A 1/2012
(Continued)

*Primary Examiner* — Paul Alvare
*Assistant Examiner* — Kirstin U Oswald
(74) *Attorney, Agent, or Firm* — Kilpatrick Townsend & Stockton LLP

(57) ABSTRACT

Disclosed is a rotating cylinder enthalpy-adding piston compressor. The compressor is a two-stage rotating cylinder piston compressor, including a first-stage rotating gas cylinder, a first gas cylinder liner, a first piston, and a second-stage rotating gas cylinder, a second gas cylinder liner, and a second piston, and further including an enthalpy-adding assembly connected between the first-stage rotating gas cylinder and the second-stage rotating gas cylinder for supplying gas and adding enthalpy between the two stages of rotating cylinders. By means of adopting a two-stage rotating cylinder piston compressor and arranging an enthalpy-adding assembly between the two stages of rotating cylinders, an enthalpy-adding function is achieved for the rotating cylinder piston compressor and the air conditioning system having same, thereby increasing the enthalpy value of the refrigerant in the system, improving the refrig-
(Continued)

erating and heating capabilities, improving the energy efficiency ratio and enhancing the reliability of the system.

13 Claims, 9 Drawing Sheets

(51) Int. Cl.
*F04C 23/00* (2006.01)
*F04C 18/32* (2006.01)
*F04C 29/00* (2006.01)

(58) Field of Classification Search
CPC ..... F04C 18/30; F04C 23/00; F04C 27/00; F04C 27/001; F04C 27/002; F04C 27/005; F01C 19/005; F01C 19/02; F01C 19/04; F01C 19/06; F04B 39/00; F04B 39/12; F04B 39/126; F04B 23/00
USPC ..... 62/510
See application file for complete search history.

(56) References Cited

U.S. PATENT DOCUMENTS 5,114,322 A * 5/1992 Caillat ..... F01C 1/0215 418/55.6
5,176,506 A * 1/1993 Siebel ..... F04B 39/0261 184/6.16
5,240,386 A * 8/1993 Amin ..... F04C 23/001 417/243
5,263,822 A * 11/1993 Fujio ..... F04C 29/025 418/55.4
6,152,714 A * 11/2000 Mitsuya ..... F01C 1/04 418/61.1
6,171,076 B1 * 1/2001 Gannaway ..... F01C 21/0809 417/244
6,179,593 B1 * 1/2001 Mitsuya ..... F04C 18/04 418/61.1
7,293,968 B2 * 11/2007 Hwang ..... F04C 18/02 418/29
7,534,100 B2 * 5/2009 Masuda ..... F01C 21/08 418/59
7,563,084 B2 * 7/2009 Kurita ..... F04C 18/322 418/29
7,753,663 B2 * 7/2010 Shimizu ..... F04C 29/128 418/59
2004/0184922 A1 * 9/2004 Cho ..... F04C 23/008 417/212
2005/0152792 A1 * 7/2005 Ogasawara ..... F01C 21/0845 417/410.3
2006/0002809 A1 * 1/2006 Kawabe ..... F04C 28/065 418/63
2006/0056988 A1 * 3/2006 Seok ..... F04C 18/3562 417/273
2006/0073051 A1 * 4/2006 Hwang ..... F04C 18/02 418/29
2006/0090488 A1 * 5/2006 Hwang ..... F04C 23/001 62/175
2006/0210418 A1 * 9/2006 Bae ..... F04C 23/008 418/125
2007/0122284 A1 * 5/2007 Bae ..... F04C 23/008 416/179
2009/0013714 A1 * 1/2009 Yamaguchi ..... F04C 23/001 62/510
2010/0003145 A1 * 1/2010 Kageyama ..... F04B 39/1073 417/269
2010/0111737 A1 * 5/2010 Higashi ..... F04C 23/008 418/11
2010/0189584 A1 * 7/2010 Byun ..... C07D 307/68 418/13
2010/0278674 A1 * 11/2010 Byun ..... F04C 18/3564 418/60
2010/0284847 A1 * 11/2010 Han ..... F04C 23/001 418/60
2011/0070115 A1 * 3/2011 Takahashi ..... F01C 21/0827 418/5
2011/0123381 A1 * 5/2011 Lee ..... F04C 18/348 418/104
2011/0138831 A1 * 6/2011 Ogata ..... F25B 9/06 62/193
2012/0128516 A1 * 5/2012 Lee ..... F04C 23/02 417/423.13
2012/0134864 A1 * 5/2012 Lee ..... F04C 29/0085 418/66
2012/0151948 A1 * 6/2012 Ogata ..... F04C 18/3564 62/157
2013/0011290 A1 * 1/2013 Okamoto ..... F01C 21/0809 418/142
2014/0010695 A1 * 1/2014 Ignatiev ..... F01C 17/06 418/55.3
2016/0061203 A1 * 3/2016 Choi ..... F04C 18/0253 418/3
2017/0298913 A1 * 10/2017 Kim ..... F04B 9/06
2017/0321937 A1 * 11/2017 Lee ..... F25B 43/02

FOREIGN PATENT DOCUMENTS

CN 102364107 A 2/2012
CN 103629112 A 3/2014
CN 105114306 A 12/2015
CN 204877941 U 12/2015
CN 105508244 A 4/2016
CN 105570128 A 5/2016
CN 106168214 A 11/2016
CN 205955988 U 2/2017
JP 1979067273 A 5/1979
JP 1999125191 A 5/1999
JP 2000170678 A 6/2000
JP 2013029059 A 2/2013

* cited by examiner

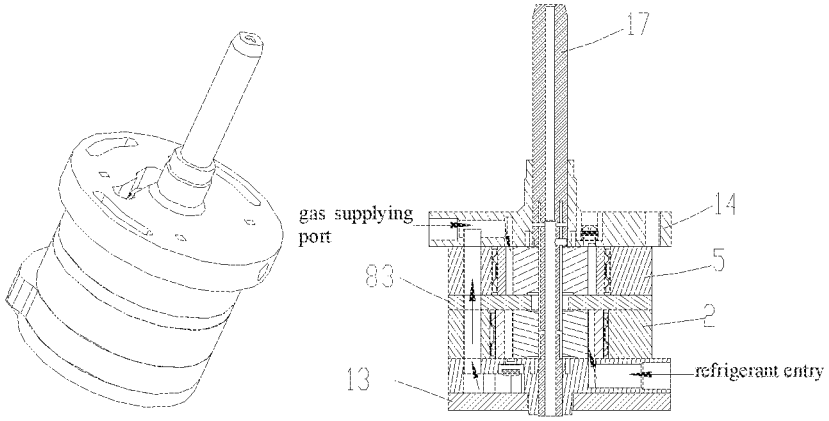
Fig.8(a) Fig.8(b)
Fig.8
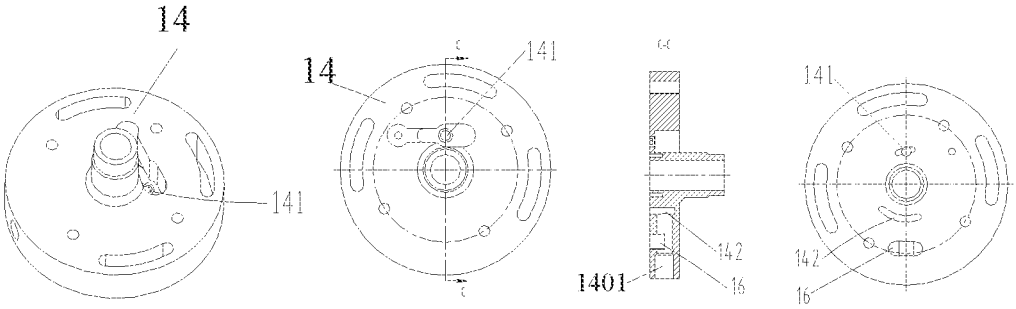
Fig. 9(a) Fig. 9(b) Fig. 9(c) Fig. 9(d)
Fig.9
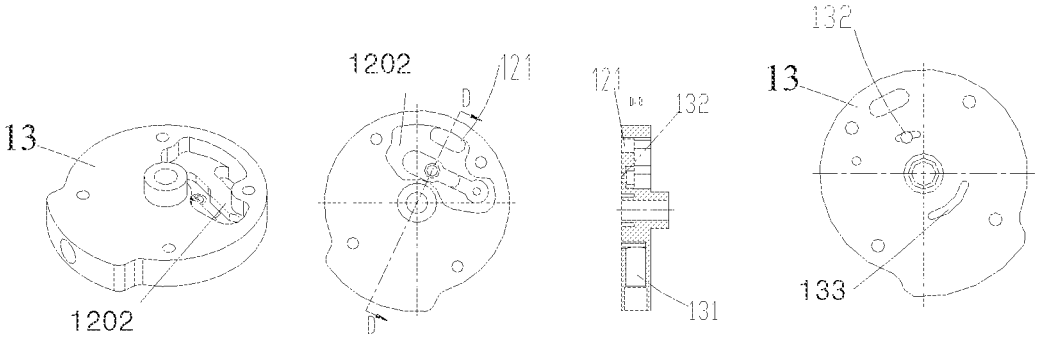
Fig. 10(a) Fig. 10(b) Fig. 10(c) Fig. 10(d)
Fig.10

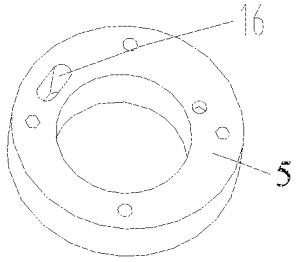
Fig.11(a)
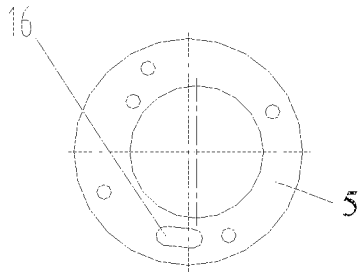
Fig.11(b)
Fig.11
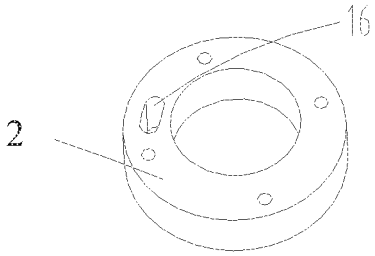
Fig.12(a)
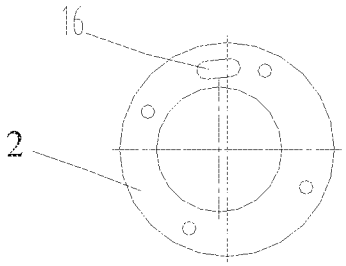
Fig.12(b)
Fig.12
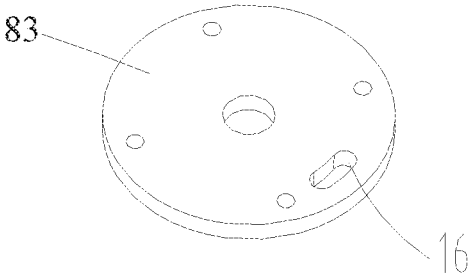
Fig.13(a)
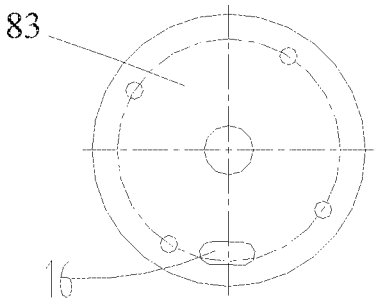
Fig.13(b)
Fig.13

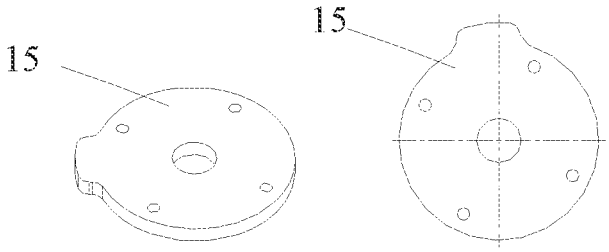
Fig. 14(a) Fig. 14(b)
Fig. 14
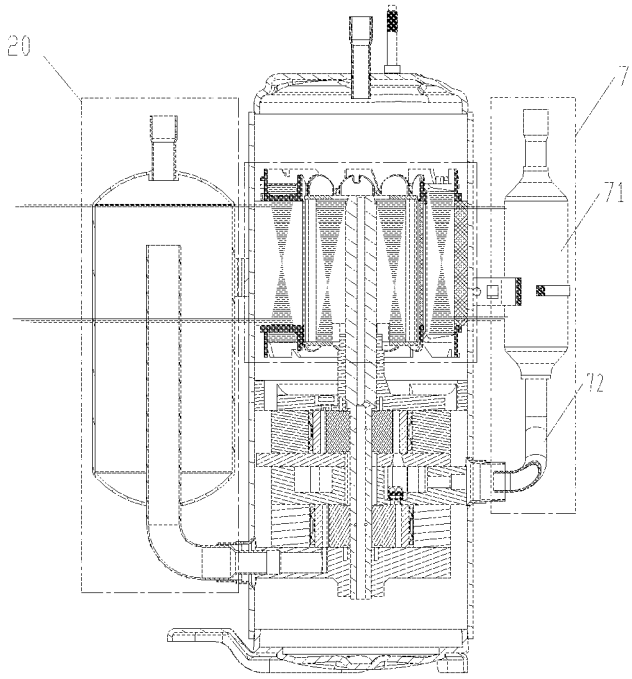
Fig. 15

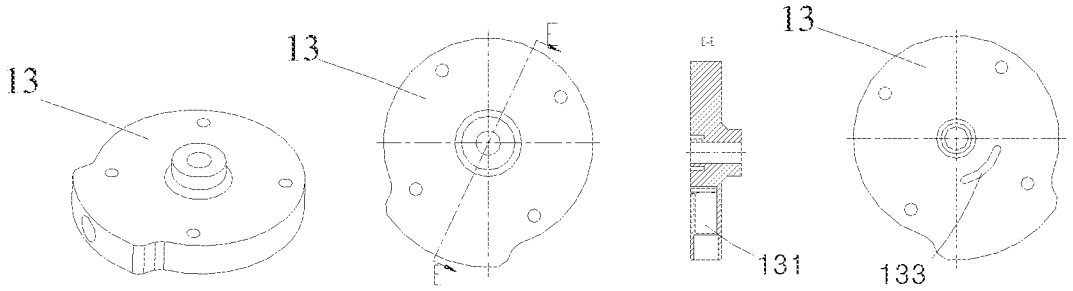
Fig.18(a) Fig.18(b) Fig.18(c) Fig.18(d)
Fig.18
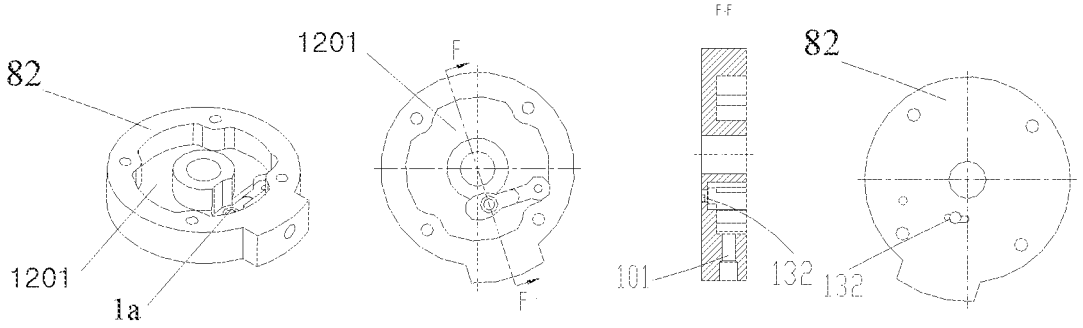
Fig.19(a) Fig.19(b) Fig.19(c) Fig.19(d)
Fig.19

ROTATING CYLINDER ENTHALPY-ADDING PISTON COMPRESSOR AND AIR CONDITIONING SYSTEM HAVING SAME

CROSS REFERENCE TO RELATED APPLICATIONS

The application is a continuation application of PCT Patent Application No. PCT/CN2017/073159, entitled "Rotating Cylinder Enthalpy-Adding Piston Compressor and Air Conditioning System Having Same", filed on Feb. 9, 2017, which claims priority to Chinese Patent Application No. 201610509297.3, entitled "Rotating Cylinder Enthalpy-Adding Piston Compressor and Air Conditioning System Having Same", filed on Jun. 29, 2016, the entire contents of which are incorporated herein by reference.

TECHNICAL FIELD

The present invention relates to the technical field of compressor, and more particularly, to a rotating cylinder enthalpy-adding piston compressor and an air conditioning system having same.

BACKGROUND

In a conventional compressor of the prior art, the refrigerant enters an air conditioning system after being compressed once, and the system has poor low-temperature refrigerating and high-temperature heating capabilities.

The two-stage enthalpy-adding technology has been applied to air conditioning systems and heat pump systems to some extent, the technology has been implemented in a rolling rotor compressor, and a rotating cylinder compressor has been previously proposed, but no related structures are found in a rotating cylinder piston compressor.

In view of the technical problems existing in the prior art rotating cylinder piston compressor and air conditioning system, such as poor refrigerating and heating capabilities, a low energy efficiency ratio and a poor reliability, the present invention develops and designs a rotating cylinder enthalpy-adding piston compressor and an air conditioning system having same.

SUMMARY OF THE INVENTION

Thus, the present invention aims to solve the technical problems so as to overcome the defect of lower energy efficiency existing in the prior art rotating cylinder piston compressor, and provides a rotating cylinder enthalpy-adding piston compressor and an air conditioning system having same.

The present invention provides a rotating cylinder enthalpy-adding piston compressor, which is a two-stage rotating cylinder piston compressor, including a first-stage rotating cylinder, a first cylinder liner, and a first piston, a second-stage rotating cylinder, a second cylinder liner and a second piston, and further including an enthalpy-adding assembly, which is connected between the first-stage rotating cylinder and the second-stage rotating cylinder, and which is configured to supply gas and add enthalpy between the two stages of rotating cylinders.

Preferably, the enthalpy-adding assembly includes an enthalpy-adding component provided outside the compressor and an enthalpy-adding pipeline configured to connect the enthalpy-adding component to an interior of the compressor.

Preferably, the rotating cylinder enthalpy-adding piston compressor further includes a partition plate arranged between the first cylinder liner and the second cylinder liner.

Preferably, the partition plate includes an upper partition plate and a lower partition plate.

Preferably, the lower partition plate is provided with a refrigerant entry passage and a gas supplying passage; and the enthalpy-adding pipeline communicates with the gas supplying passage.

Preferably, the lower partition plate is provided with a concavity, and a first-stage cylinder gas-intake cavity and a first intermediate cavity are formed between the concavity and the upper partition plate.

Preferably, the first-stage cylinder gas-intake cavity communicates with the refrigerant entry passage; and the first intermediate cavity communicates with the gas supplying passage and a discharge end of the first-stage rotating cylinder respectively.

Preferably, the lower partition plate is provided with a gas supplying passage; the enthalpy-adding pipeline communicates with the gas supplying passage; the compressor further comprises a lower flange, and a refrigerant entry passage is disposed in the lower flange.

Preferably, the lower partition plate is provided with a concavity, and a first intermediate cavity is formed between the concavity and the upper partition plate.

Preferably, the refrigerant entry passage communicates with a gas entry end of the first-stage rotating cylinder; and the first intermediate cavity communicates with the gas supplying passage and a discharge end of the first-stage rotating cylinder respectively.

Preferably, the partition plates comprises an intermediate partition plate; the compressor further includes an upper flange and a lower flange; a refrigerant entry passage is disposed in the lower flange, and a gas supplying passage is provided in the upper flange; and the enthalpy-adding pipeline communicates with the gas supplying passage.

Preferably, the rotating cylinder enthalpy-adding piston compressor further includes a lower cover plate; a second intermediate cavity is formed between the lower flange and the lower cover plate.

Preferably, the refrigerant entry passage communicates with a gas entry end of the first-stage rotating cylinder; the first cylinder liner communicates with the second cylinder liner and the intermediate partition plate to form a flow passage; one end of the flow passage communicates with the second intermediate cavity, and another end of the flow passage communicates with the gas supplying passage in the upper flange.

The present invention further provides an air conditioning system comprising the rotating cylinder enthalpy-adding piston compressor above.

The rotating cylinder enthalpy-adding piston compressor and the air conditioning system with the same provided by the present invention have the beneficial effects as follows:

According to the rotating cylinder enthalpy-adding piston compressor of the present invention, by means of adopting a two-stage rotating cylinder piston compressor and arranging an enthalpy-adding assembly between the two stages of rotating cylinders, the enthalpy-adding function can be achieved, thereby increasing the enthalpy value of the refrigerant in the system, improving refrigerating and heating capabilities, improving the energy efficiency ratio and enhancing the reliability of the system.

DRAWINGS

Figure 4A:
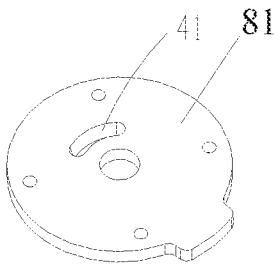
Figure 4B:
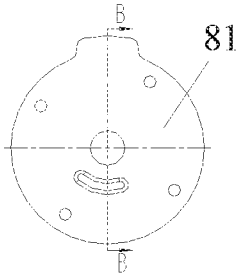
Figure 4C:
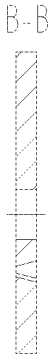
Figure 5A:
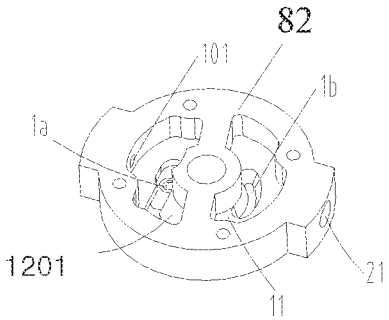
Figure 5B:
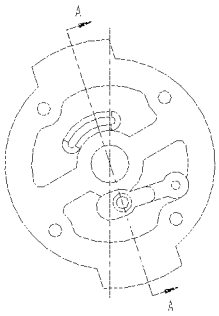
Figure 5C:
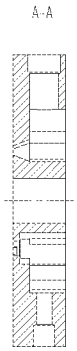
Figure 5D:
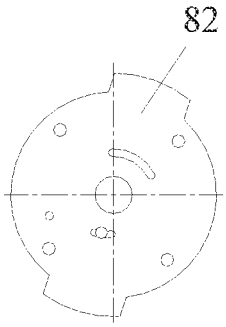
Figure 6:
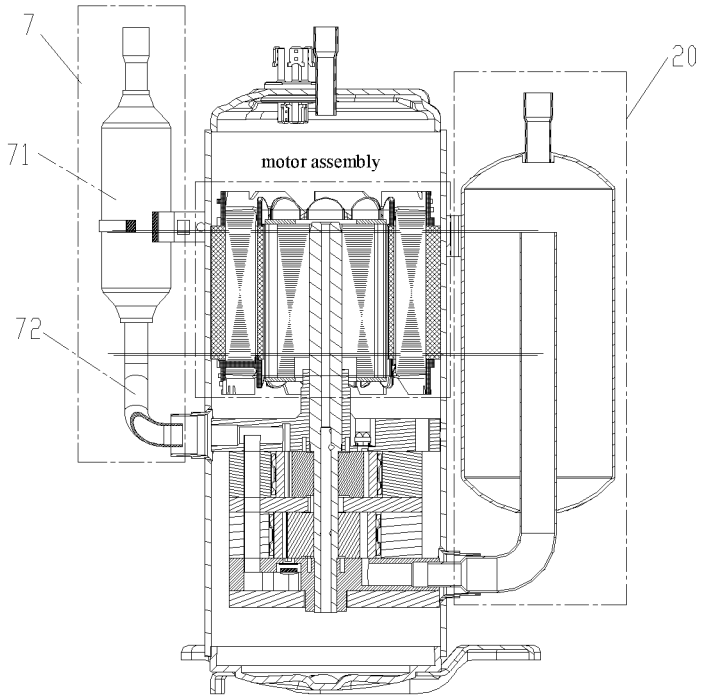
Figure 7:
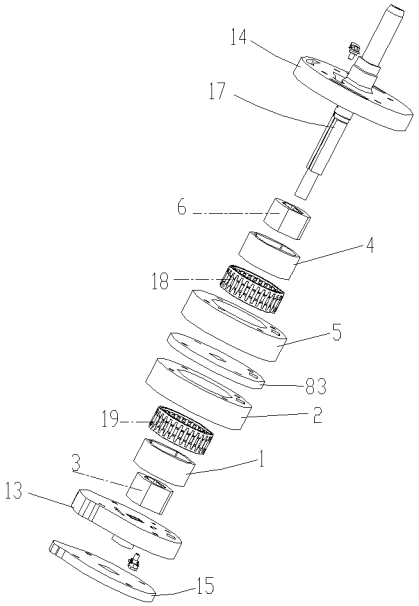
Figure 16:
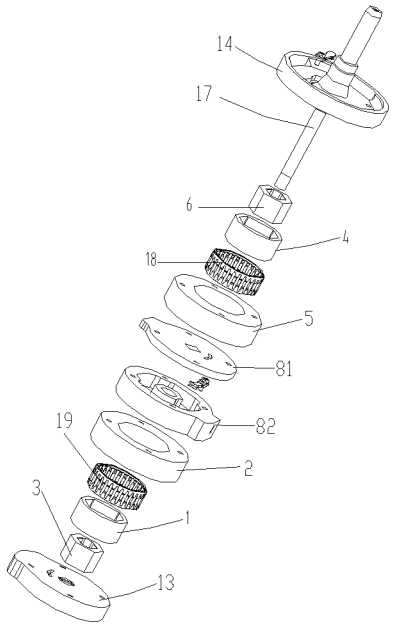
Figure 17:
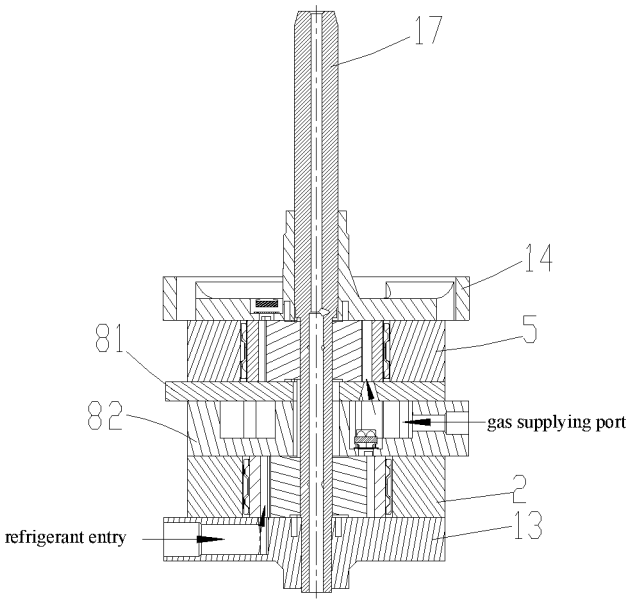

wherein, FIG. 3 (*a*) is a schematic stereo structural diagram of the pump body assembly; FIG. 3(*b*) is a front longitudinal sectional view of the pump body assembly; FIG. 3(*c*) is a side longitudinal sectional view of the pump body assembly; FIG. 3(*d*) is a top cross sectional view of the upper cylinder; FIG. 3(*e*) is a top cross sectional view of the lower cylinder;

FIG. 4 shows schematic structural diagrams of the upper partition plate of the rotating cylinder enthalpy-adding piston compressor according to the first embodiment of the present invention;

wherein, FIG. 4(*a*) is a schematic stereo diagram of the upper partition plate; FIG. 4(*b*) is a top schematic view of the upper partition plate; FIG. 4(*c*) is a cross-sectional view along the line B-B of FIG. 4(*b*);

FIG. 5 shows schematic structural diagrams of the lower partition plate of the rotating cylinder enthalpy-adding piston compressor according to the first embodiment of the present invention;

wherein, FIG. 5(*a*) is a schematic stereo diagram of the lower partition plate; FIG. 5(*b*) is a top view of the lower partition plate; FIG. 5(*c*) is a cross-sectional view along the line A-A of FIG. 5(*b*); FIG. 5(*d*) is a bottom view of FIG. 5(*a*);

FIG. 6 is a schematic structural assembly diagram of the rotating cylinder enthalpy-adding piston compressor according to the second embodiment of the present invention;

FIG. 7 is a schematic exploded diagram of a pump body assembly of the rotating cylinder enthalpy-adding piston compressor according to the second embodiment of the present invention;

FIG. 8 shows schematic structural assembly diagrams of the assembled pump body of the rotating cylinder enthalpy-adding piston compressor according to the second embodiment of the present invention;

wherein, FIG. 8 (*a*) is a schematic stereo structural diagram of the pump body assembly; FIG. 8(*b*) is a front longitudinal sectional view of the pump body assembly;

FIG. 9 shows schematic structural diagrams of the upper flange of the rotating cylinder enthalpy-adding piston compressor according to the second embodiment of the present invention;

wherein, FIG. 9(*a*) is a schematic stereo diagram of the upper flange; FIG. 9(*b*) is a top schematic view of the upper flange; FIG. 9(*c*) is a cross-sectional view along the line C-C of FIG. 9(*b*); FIG. 9(*d*) is a bottom view of FIG. 9(*a*);

FIG. 10 shows schematic structural diagrams of the lower flange of the rotating cylinder enthalpy-adding piston compressor according to the second embodiment of the present invention;

wherein, FIG. 10(*a*) is a schematic stereo diagram of the lower flange; FIG. 10(*b*) is a top view of the lower flange; FIG. 10(*c*) is a cross-sectional view along the line D-D of FIG. 10(*b*); FIG. 10(*d*) is a bottom view of FIG. 10(*a*);

FIG. 11 shows schematic structural diagrams of the upper cylinder liner of the rotating cylinder enthalpy-adding piston compressor according to the second embodiment of the present invention;

wherein, FIG. 11(*a*) is a schematic stereo diagram of the upper cylinder liner; FIG. 11(*b*) is a top schematic view of the upper cylinder liner;

FIG. 12 shows schematic structural diagrams of the lower cylinder liner of the rotating cylinder enthalpy-adding piston compressor according to the second embodiment of the present invention;

wherein, FIG. 12(*a*) is a schematic stereo diagram of the lower cylinder liner; FIG. 12(*b*) is a top schematic view of the lower cylinder liner;

FIG. 13 shows schematic structural diagrams of the intermediate partition plate of the rotating cylinder enthalpy-adding piston compressor according to the second embodiment of the present invention;

wherein, FIG. 13(*a*) is a schematic stereo diagram of the intermediate partition plate;

FIG. 13(*b*) is a top schematic view of the intermediate partition plate;

FIG. 14 shows schematic structural diagrams of the lower cover plate of the rotating cylinder enthalpy-adding piston compressor according to the second embodiment of the present invention;

wherein, FIG. 14(*a*) is a schematic stereo diagram of the lower cover plate; FIG. 14(*b*) is a top schematic view of the lower cover plate;

FIG. 15 is a schematic structural assembly diagram of the rotating cylinder enthalpy-adding piston compressor according to the third embodiment of the present invention;

FIG. 16 is a schematic exploded diagram of the pump body assembly of the rotating cylinder enthalpy-adding piston compressor according to the third embodiment of the present invention;

FIG. 17 is a schematic structural diagram of the assembled pump body of the rotating cylinder enthalpy-adding piston compressor according to the third embodiment of the present invention;

FIG. 18 shows schematic structural diagrams of the lower flange of the rotating cylinder enthalpy-adding piston compressor according to the third embodiment of the present invention;

wherein, FIG. 18(*a*) is a schematic stereo diagram of the lower flange; FIG. 18(*b*) is a top view of the lower flange; FIG. 18(*c*) is a cross-sectional view along the line E-E of FIG. 18(*b*); FIG. 18(*d*) is a bottom view of FIG. 18(*a*);

FIG. 19 shows schematic structural diagrams of the lower partition plate of the rotating cylinder enthalpy-adding piston compressor according to the third embodiment of the present invention;

wherein, FIG. 19(*a*) is a schematic stereo diagram of the lower partition plate; FIG. 19(*b*) is a top view of the lower partition plate; FIG. 19(*c*) is a cross-sectional view along the line F-F of FIG. 19(*b*); FIG. 19(*d*) is a bottom view of FIG. 19(*a*).

The reference numerals in the Figures are indicated as:

1—first-stage rotating cylinder (or lower cylinder), 1*a*—first lower partition plate port,

1*b*—second lower partition plate port,

2—first cylinder liner (or lower cylinder liner), 3—first piston (or lower piston),

4—second-stage rotating cylinder (or upper cylinder), 41—upper partition plate gas-intake port,

5—second cylinder liner (or upper cylinder liner), 6—second piston (or upper piston),

7—enthalpy-adding assembly, 71—enthalpy-adding component, 72—enthalpy-adding pipeline,

81—upper partition plate, 82—lower partition plate, 83—intermediate partition plate,

9—refrigerant entry passage, 10—gas supplying passage, 101—lower partition plate gas supplying port,

11—first-stage cylinder gas-intake cavity (or lower cylinder gas-intake cavity),

1201—first intermediate cavity, 1202—second intermediate cavity, 121—gas flow passage of the intermediate cavity,

13—lower flange, 131—gas-intake port of lower flange, 132—sunk groove of lower flange discharge port,

133—sunk groove of the lower flange gas-intake port,

14—upper flange, 141—upper flange discharge port, 142—upper flange gas-intake port, 1401—upper flange gas supplying port

15—lower cover plate, 16—flow passage, 17—rotation shaft,

18—upper retainer assembly of needle roller, 19—lower retainer assembly of needle roller,

20—liquid separator, 21—lower partition plate gas-intake port.

DETAILED DESCRIPTION OF THE PREFERRED EMBODIMENTS

As shown in FIGS. 1-19, the present invention provides a rotating cylinder enthalpy-adding piston compressor. It is a two-stage rotating cylinder piston compressor, including a first-stage rotating cylinder 1, a first cylinder liner 2, and a first piston 3, a second-stage rotating cylinder 4, a second cylinder liner 5 and a second piston 6, and further including an enthalpy-adding assembly 7, which is connected between the first-stage rotating cylinder 1 and the second-stage rotating cylinder 4, and which is configured to supply gas and add enthalpy between the two stages of rotating cylinders. By means of adopting the two-stage rotating cylinder piston compressor and arranging the enthalpy-adding assembly between the two stages of rotating cylinders, the rotating cylinder enthalpy-adding piston compressor of the present invention can achieve the enthalpy-adding function, thereby increasing the enthalpy value of the refrigerant in the system, improving refrigerating and heating capabilities, improving the energy efficiency ratio and enhancing the reliability of the system.

Figure 1:
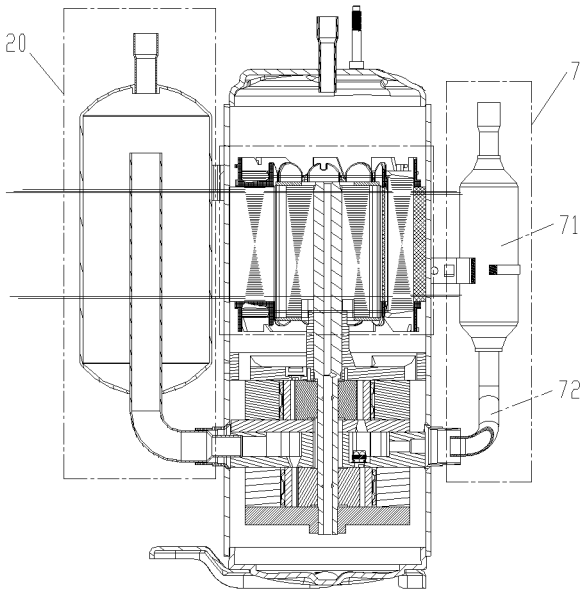
FIG. 1 is a schematic structural assembly diagram of a rotating cylinder enthalpy-adding piston compressor according to the first embodiment of the present invention.

Preferably, the enthalpy-adding assembly 7 is known in the art and includes an enthalpy-adding component 71 provided outside the compressor and an enthalpy-adding pipeline 72, which is configured to connect the enthalpy-adding component 71 to the interior of the compressor. As shown in FIG. 1, the enthalpy-adding component 71 is a liquid storage tank. By means of the enthalpy-adding assembly comprising the enthalpy-adding component and the enthalpy-adding pipeline connected therewith, the enthalpy-adding component conveys the medium-pressure refrigerant into the compressor through the enthalpy-adding pipeline, thereby realizing the functions and the effects of supplying gas and adding enthalpy.

Preferably, the rotating cylinder enthalpy-adding piston compressor further includes partition plates arranged between the first cylinder liner 2 and the second cylinder liner 5. The partition plates are disposed between the first cylinder liner and the second cylinder liner, which enables partition plates to effectively form isolation and a barrier between the two cylinder liners, thereby preventing mutual interferences caused by the movements of the cylinder liners, effectively reducing vibrations and noises. What's more, the structure of the partition plate provides a structural condition for providing a gas supplying passage and a low-pressure gas-intake passage.

Preferably, the partition plates include an upper partition plate 81 and a lower partition plate 82. Through the structure form of the partition plates including the upper partition plate and the lower partition plate, the upper partition plate can isolate and block the upper cylinder liner, and the lower partition plate can isolate and block the lower cylinder liner. During the operation of the two cylinders, the two partition plates can effectively isolate the two cylinders, thereby preventing interacts on the two cylinders. What's more, the upper partition plate and the lower partition plate can provide a structural condition for providing the gas supplying passage and the low-pressure gas-intake passage.

Preferably, the lower partition plate 82 is provided with a refrigerant entry passage 9 and a gas supplying passage 10. The enthalpy-adding pipeline 72 communicates with the gas supplying passage 10. The specific executive means of the first embodiment of the present invention are as follows: the refrigerant entry passage and the gas supplying passage are disposed in the lower partition plate, and the enthalpy-adding pipeline communicates with the gas supplying passage, which enables the low-pressure high-temperature refrigerant from outside to be introduced, through the lower partition plate, into the compressor and be compressed in the compressor, and enables the medium-pressure refrigerant to be introduced, through the lower partition plate, into the compressor to supply gas refrigerant and increase refrigerant enthalpy, thereby improving the refrigerating and heating capacities and the energy efficiency of the compressor, and even of the air conditioning system.

Preferably, the lower partition plate 82 is provided with a concavity, and a first-stage cylinder gas-intake cavity 11 (namely, a lower cylinder gas-intake cavity) and a first intermediate cavity 1201 are formed between the concavity and the upper partition plate 81. The concavity provided in the lower partition plate, which enables the first-stage cylinder gas-intake cavity 11 and the first intermediate cavity 1201 to be formed between the concavity and the upper partition plate, thereby providing a structural condition for storing the sucked low-pressure gas and storing the supplied medium-pressure gas of the compressor.

Preferably, the first-stage cylinder gas-intake cavity 11 communicates with the refrigerant entry passage 9. The first intermediate cavity 1201 communicates with the gas supplying passage 10 and the discharge end of the first-stage rotating cylinder 1 respectively. The first-stage cylinder gas-intake cavity 11 communicates with the refrigerant entry passage 9, which enables the low-pressure low-temperature refrigerant that enters the compressor through the refrigerant entry passage 9 from outside to be stored in the first-stage cylinder gas-intake cavity 11, thereby providing conditions for further compressing the refrigerant in the first-stage cylinder 1. The first intermediate cavity 1201 communicates with the gas supplying passage 10 and the discharge end of the first-stage rotating cylinder 1 respectively, which enables the refrigerant that is discharged from the discharge end of the first-stage cylinder 1 to be mixed in the first intermediate cavity 1201 with the refrigerant from the gas supplying passage 10, and to be stored in the intermediate cavity, thereby realizing the functions of mixing the supplied medium-pressure gas, and providing conditions for the second-stage compression.

Preferably, the lower partition plate 82 is provided with a gas supplying passage 10. The enthalpy-adding pipeline 72 communicates with the gas supplying passage 10. The compressor further includes a lower flange 13, and a refrigerant entry passage 9 is disposed in the lower flange 13. The specific executive means of the third embodiment of the present invention are as follows: the gas supplying passage is disposed in the lower partition plate, and the enthalpy-adding pipeline 72 communicates with the gas supplying passage 10, which enables the medium-pressure refrigerant to be introduced, through the lower partition plate 82, into the compressor to realize the function of supplying gas and adding enthalpy, thereby improving the refrigerating and heating capacities and the energy efficiency of the compressor and even of the air conditioning system; the lower flange 13 is provided with the refrigerant entry passage, which enables the outside low-pressure high-temperature refrigerant from outside to be introduced into the compressor through the lower flange 13, and to be compressed in the compressor.

Preferably, the lower partition plate 82 is provided with a concavity, and a first intermediate cavity 1201 is formed between the concavity and the upper partition plate 81. The concavity is disposed on the lower partition plate 82, which enables the first-stage cylinder gas-intake cavity 11 and the first intermediate cavity 1201 to be formed between the concavity and the upper partition plate 81, thereby providing a structural condition for storing the sucked low-pressure gas and storing the supplied medium-pressure gas of the compressor.

Preferably, the refrigerant entry passage 9 communicates with the gas entry end of the first-stage rotating cylinder 1. The first intermediate cavity 1201 communicates with the gas supplying passage 10 and the discharge end of the first-stage rotating cylinder 1 respectively. The gas-intake end of the first-stage rotating cylinder communicates with the refrigerant entry passage, which enables the low-pressure low-temperature refrigerant that enters the compressor through the refrigerant entry passage from outside to be sent into and compressed in the first-stage cylinder. The first intermediate cavity 1201 communicates with the gas supplying passage 10 and the discharge end of the first-stage rotating cylinder 1 respectively, which enables the refrigerant discharged from the discharge end of the first-stage rotating cylinder 1 to be mixed in the first intermediate cavity 1201 with the refrigerant from the gas supplying passage 10, and to be stored in the intermediate cavity, thereby realizing the functions of mixing the supplied medium-pressure gas, and providing conditions for the second-stage compression.

Preferably, the partition plates include an intermediate partition plate 83; the compressor further includes an upper flange 14 and a lower flange 13. A refrigerant entry passage 9 is disposed in the lower flange 13, and a gas supplying passage 10 is provided in the upper flange 14. The enthalpy-adding pipeline 72 communicates with the gas supplying passage 10. The specific executive means of the second embodiment of the present invention are as follows: the gas supplying passage 10 is disposed in the upper flange 14, and the enthalpy-adding pipeline communicates with the gas supplying passage 10, which enables the medium-pressure refrigerant to be introduced, through the upper flange 14, into the compressor to realize the function of supplying gas and adding enthalpy, thereby improving the refrigerating and heating capacities and the energy efficiency of the compressor and even of the air conditioning system; the lower flange 13 is provided with the refrigerant entry passage 9, which enables the low-pressure high-temperature refrigerant from outside to be introduced into the compressor through the lower flange 13, and to be compressed in the compressor.

Preferably, the compressor further includes a lower cover plate 15. The lower flange 13 is provided with a sunk concavity, and a second intermediate cavity 1202 is formed between the sunk concavity and the lower cover plate 15. The lower flange 13 is provided with the sunk concavity, which enables the first-stage cylinder gas-intake cavity 11 and the second intermediate cavity 1202 to be formed between the sunk concavity and the lower cover plate 15, thereby providing the structural conditions for storing the sucked low-pressure gas, and storing the supplied medium-pressure gas of the compressor.

Preferably, the refrigerant entry passage 9 communicates with a gas entry end of the first-stage rotating cylinder 1. The first cylinder liner 2 communicated with the second cylinder liner 5 and the intermediate partition plate 83 to form a flow passage 16. One end of the flow passage 16 communicates with the first intermediate cavity 1201, and the other end of the flow passage 16 communicates with the gas supplying passage 10 in the upper flange 14. The gas entry end of the first-stage rotating cylinder communicates with the refrigerant entry passage, which enables the low-pressure low-temperature refrigerant that enters the compressor through the refrigerant entry passage from outside to be sent into and compressed in the first-stage cylinder. The first cylinder liner communicates with the second cylinder liner and the intermediate partition plate to form the flow passage, and one end of the flow passage communicates with the first intermediate cavity 1201, and the other end of the flow passage communicates with the gas supplying passage 10 in the upper flange 14, which enables the first intermediate cavity 1201 to communicate with the gas supplying passage 10 through the flow passage 9, and enables the refrigerant discharged from the intermediate cavity to be mixed with the refrigerant from the gas supplying passage and to be stored, thereby realizing the function of mixing the supplied medium-pressure gas, and further providing conditions for the second-stage compression.

The present invention also provides an air conditioning system comprising said rotating cylinder enthalpy-adding piston compressor. By means of adopting the two-stage rotating cylinder piston compressor and adopting a structure of the enthalpy-adding assembly arranged between two stages of rotating cylinders, the rotating cylinder enthalpy-adding piston compressor and the air conditioning system with the same of the present invention can achieve the function of adding enthalpy, thereby adding the refrigerant enthalpy of the system, improving refrigerating and heating capabilities of the system, and improving the energy efficiency ratio and the reliability of the system.

The working principle and the preferred embodiments of the present invention will be described thereafter.

Figure 2:
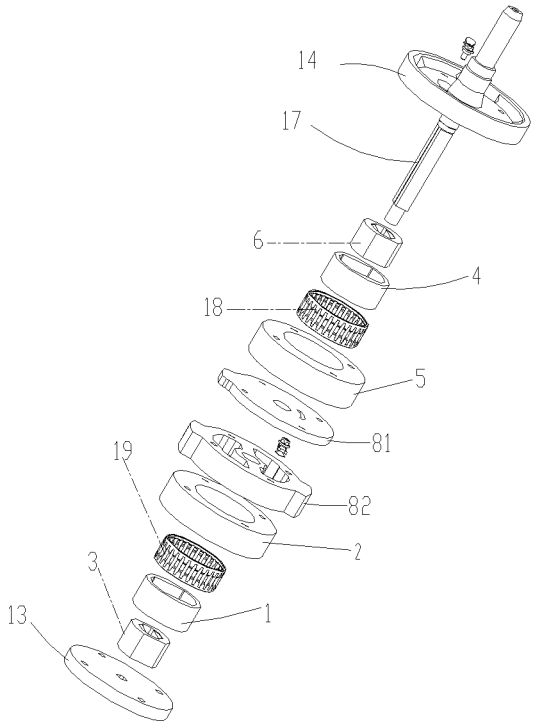
FIG. 2 is a schematic exploded diagram of a pump body assembly of the rotating cylinder enthalpy-adding piston compressor according to the first embodiment of the present invention.
Figure 3A:
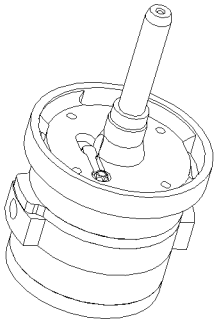
FIG. 3 shows schematic structural diagrams of the assembled pump body of the rotating cylinder enthalpy-adding piston compressor according to the first embodiment of the present invention.
Figure 3B:
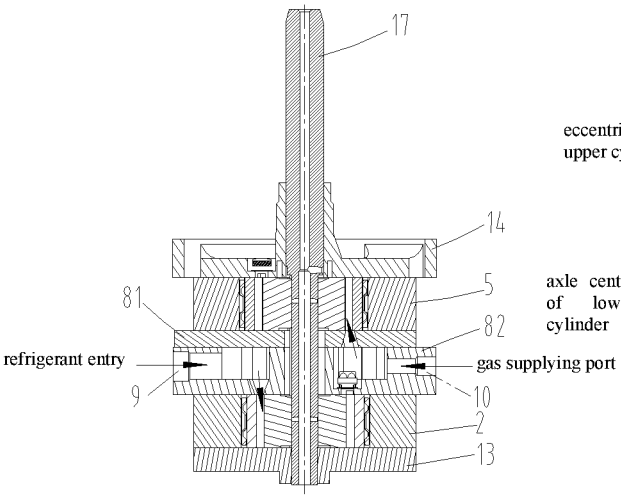
Figure 3C:
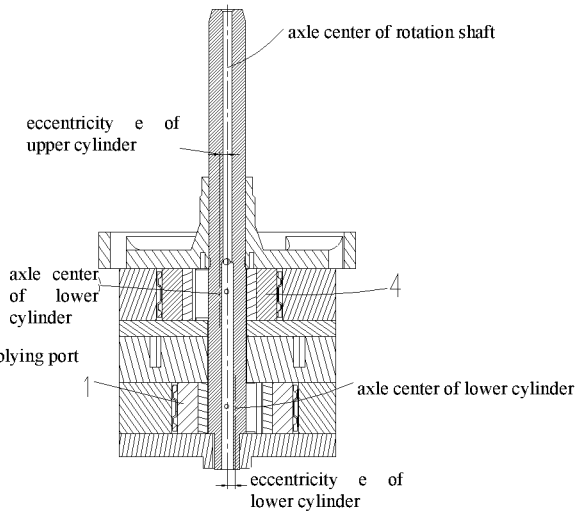
Figure 3D:
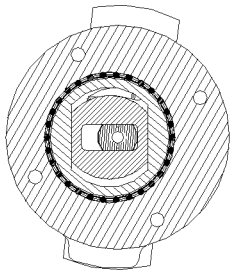
Figure 3E:
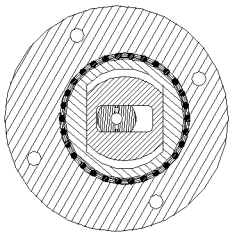

The present invention adopts two-stage enthalpy-adding technology on the basis of the double-cylinder rotating cylinder compressor, and the specific implementations are as follows:

The first embodiment is shown in FIGS. 1-5:

the compressor pump body mainly includes an upper flange 14, a rotation shaft 17, an upper piston 6, an upper cylinder 4, an upper cylinder liner 5, an upper retainer assembly of needle roller 18, a lower flange 13, a lower piston 3, a lower cylinder 1, a lower cylinder liner 2, a lower retainer assembly of needle roller 19, an upper partition plate 81 and a lower partition plate 82, and the assembly method is shown in FIG. 2.

The upper partition plate 81 is a flat plate with a certain roughness requirement. One side of the upper partition plate 81 is coupled with the upper cylinder 4, the upper piston 6 and the upper cylinder liner 5; the other side of the upper partition plate is coupled with the lower partition plate 82;

the center of the upper partition plate 81 has a through orifice with a diameter slightly greater than the diameter of the piston bearing element of the rotation shaft; the lower partition plate 82 is further provided with a upper partition plate gas-intake port 41 with a certain angle, which communicates with the lower cylinder gas-intake cavity 11 defined in the lower partition plate 82 and is disposed at the position corresponding to the gas-intake position of the upper cylinder 4. See FIGS. 4 and 3.

Two concavities with certain shapes are disposed between an inner orifice and an outer circle of the lower partition plate 82, and are coupled with the upper partition plate 81 to form the first intermediate cavity 1201 and a lower cylinder gas-intake cavity 11 respectively. One side of the outer circle has a lower partition plate gas-intake port 21 which communicates with the lower cylinder gas-intake cavity 11, and the other side of the outer circle has a lower partition plate gas supplying port 101 which communicates with the first intermediate cavity 1201. The end surface of the lower partition plate 82 is provided with a diagonal cut, namely, the a second lower partition plate port 1*b*, which communicates with the lower cylinder gas-intake cavity 11, and which is disposed at the position corresponding to gas-intake position of the lower cylinder cavity and opposite to the upper partition plate gas-intake port 41 respectively. The other side of the lower partition plate 82 has a groove, which is a discharge groove. A first lower partition plate port 1*a* is disposed adjacent to the discharge groove and is arranged corresponding to the discharge position of the lower cylinder cavity. A discharge valve plate and a valve baffle are arranged at the first lower partition plate port 1*a* and are fixed in the groove adjacent to the first lower partition plate port 1*a* with a valve screw, so that the discharge valve plate could exactly cover the first lower partition plate port 1*a*. See FIG. 5.

The operating principle of the compressor is as follows:

The refrigerant from the liquid separator 20 enters the gas-intake cavity through the gas-intake port 21 in the lower partition plate 82, then enters the lower cylinder cavity through the lower cylinder gas-intake port; after being compressed by the lower cylinder, the refrigerant enters the first intermediate cavity 1201 through the lower cylinder discharge port; and the first-stage compression of the refrigerant is completed;

The supplied enthalpy-adding gas from the enthalpy-adding component 71 enters the first intermediate cavity 1201 through the lower partition plate gas supplying port 101, and is mixed with the first-stage compressed refrigerant, reducing the temperature of the sucked gas of the second-stage compression; the mixed gas enters the upper cylinder cavity through the upper partition plate gas-intake port 41 in the upper partition plate, and after being compressed by the upper cylinder 4, the supplied enthalpy-adding gas is finally discharged from the upper flange discharge port 141; and the second-stage compression is completed.

See FIGS. 1 and 3.

The second embodiment is shown in FIGS. 6-14:

The compressor pump body includes a rotation shaft 17, an upper flange 14, an upper cylinder liner 5, an upper cylinder 4, an upper piston 6, an upper retainer assembly of needle roller 18, an intermediate partition plate 83, a lower cylinder liner 2, a lower cylinder 1, and a lower piston 3, a lower retainer assembly of needle roller 19, a lower flange 13, a lower cover plate 15, and the assembly method is shown in FIG. 8.

The upper flange has a single-cylinder full-bearing structure, and is further provided with a flow passage 16 and an upper flange gas-intake port 142. Coupled with the upper cylinder 4, an end surface of the upper flange 14 is provided with two sunk grooves, which are the upper flange gas-intake port 142 and the flow passage 16 respectively. An opening is disposed radially in the upper flange 14. The opening is configured to be an upper flange gas supplying port 1401 which communicates with the upper flange gas-intake port 142 and the sunk groove of the flow passage 16. See FIG. 10.

A gas-intake port 131 is further provided radially in the lower flange 13, and the diameter of the outer circle of the gas-intake port 131 is identical with the inner diameter of the casing; coupled with the lower cylinder 1, an end surface of the lower flange 13 is provided with a sunk groove 133 of the gas-intake port 131 and a sunk groove 132 of the lower flange discharge port. The sunk groove 133 of the gas-intake port 131 communicates with the gas-intake port 131 provided radially; a discharge port is disposed adjacent to the sunk groove 132 of the lower flange discharge port; an upper end surface of the lower flange 13 is provided with a sunk concavity, which communicates with the discharge port, and a second intermediate cavity 1202 is formed between the sunk concavity and the lower cover plate 15; an edge of the second intermediate cavity 1202 is provided with a kidney-shaped port, which is a gas flow passage 121 of the second intermediate cavity 1202 and communicates with the flow passage of the lower cylinder liner 2, the flow passage of the intermediate partition plate 83 and the flow passage of the upper cylinder liner 5. See FIG. 10.

The upper cylinder liner 5, the lower cylinder liner 2 and the intermediate partition plate 83 are respectively further provided with a flow passage communicating with the second intermediate cavity 1202 on the lower flange 13.

The lower cover plate 15 is a flat plate with certain roughness requirement. One side of the lower cover plate 15 is coupled with the lower flange 13 to form the second intermediate cavity 1202; a thorough orifice is disposed in the center of the lower cover plate 15, and the diameter of the thorough orifice is slightly greater than the outer diameter of the boss of the lower flange 13. See FIG. 14.

The operating principle of the compressor is:

The refrigerant from the liquid separator 20 enters the lower cylinder cavity through the gas-intake port 131 in the lower flange 13 and the gas-intake port of the lower cylinder, and after being compressed in the lower cylinder 1, the refrigerant enters the second intermediate cavity 1202 through the lower cylinder discharge port, and the first-stage compression of the refrigerant is completed;

The refrigerant in the second intermediate cavity 1202 enters the gas-intake passage of the upper flange through the flow passage 121 of the lower flange 13, the flow passage of the lower cylinder liner 2, the flow passage of the intermediate partition plate 83, the flow passage of the upper cylinder liner 5, and the flow passage 16 of the upper flange 14, and is mixed with the refrigerant entering from the upper flange gas supplying port 1401, reducing the temperature of the sucked gas of the second-stage compression; the mixed gas enters the upper cylinder cavity, and finally, after being compressed by the upper cylinder 4, the refrigerant is discharged from the upper flange discharge port 141; and the second-stage compression is completed. See FIG. 8.

The third embodiment is shown in FIGS. 15-19:

The compressor pump body includes a rotation shaft 17, an upper flange 14, an upper cylinder liner 5, an upper cylinder 4, an upper piston 6, an upper retainer assembly of needle roller 18, an upper partition plate 81, a lower partition plate 82, a lower cylinder liner 2, a lower cylinder 1, a lower piston 3, a lower retainer assembly of needle roller 19 and a lower flange 13, and the assembly method is shown in FIG. 16.

What different from the first embodiment is that:

A gas-intake port 131 is further provided radially in the lower flange 13, and the diameter of an outer circle of the gas-intake port 131 is identical with the inner diameter of a casing; coupled with the lower cylinder 1, an end surface of the lower flange 13 is provided with a sunk groove 133 of the gas-intake port 131, which communicates with the gas-intake port 131 provided radially; see FIG. 18.

A concavity with a certain shape is disposed between an inner orifice and an outer circle of the lower partition plate 82, and is coupled with the upper partition plate 81 to form a first intermediate cavity 1201. A lower partition plate gas supplying port 101 is radially opened to the outer circle and communicates with the first intermediate cavity 1201. The end surface of the lower partition plate 82 is provided with a groove, which is a discharge groove. A first lower partition plate port 1*a* is disposed adjacent to the discharge groove and is arranged corresponding the discharge position of the lower cylinder cavity; a discharge valve plate and a valve baffle are arranged at the first lower partition plate port 1*a* and are fixed in the groove at the first lower partition plate port 1*a* with a valve screw, so that the discharge valve plate could exactly cover the first lower partition plate port 1*a*. See FIG. 19.

The operating principle of the compressor is as follows:

the refrigerant from the liquid separator 20 enters the lower cylinder cavity through the gas-intake port 131 of the lower flange and the lower cylinder gas-intake port; after being compressed by the lower cylinder 1, the refrigerant enters the first intermediate cavity 1201 of the lower partition plate 82 through the lower cylinder discharge port; and the first-stage compression of the refrigerant is completed;

the supplied enthalpy-adding gas from the enthalpy-adding component 71 enters the first intermediate cavity 1201 through the lower partition plate gas supplying port 101, and is mixed with the first-stage compressed refrigerant, reducing the temperature of the sucked gas of the second-stage compression; the mixed gas enters the upper cylinder cavity through the upper partition plate gas-intake port 41 in the upper partition plate 81; after being compressed by the upper cylinder 4, the supplied enthalpy-adding gas is finally discharged from the upper flange discharge port; and the second-stage compression is completed. See FIG. 17.

What is claimed is:

1. A rotating cylinder enthalpy-adding piston compressor, comprising:

a two-stage rotating cylinder piston compressor, comprising:

a first-stage rotating cylinder;

a first cylinder liner;

a first piston;

a second-stage rotating cylinder;

a second cylinder liner;

a second piston;

an enthalpy-adding assembly, which is connected between the first-stage rotating cylinder and the second-stage rotating cylinder, and which is configured to supply gas and add enthalpy between two stages of rotating cylinders; and an upper partition plate and a lower partition plate arranged between the first cylinder liner and the second cylinder liner; wherein two concavities with certain shapes are disposed between an inner orifice and an outer circle of the lower partition plate, and are coupled with the upper partition plate to form a first intermediate cavity and a lower cylinder gas-intake cavity respectively;

one side of the outer circle has a lower partition plate gas-intake port which communicates with the lower cylinder gas-intake cavity, and another side of the outer circle has a lower partition plate gas supplying port which communicates with the first intermediate cavity;

an end surface of the lower partition plate is provided with a diagonal cut, and the diagonal cut is a second lower partition plate port, which communicates with the lower cylinder gas-intake cavity, and which is disposed at a position corresponding to a gas-intake position of a lower cylinder cavity and opposite to an upper partition plate gas-intake port respectively;

another side of the lower partition plate has a groove, which is a discharge groove;

a first lower partition plate port is disposed adjacent to the discharge groove and is arranged corresponding to a discharge position of the lower cylinder cavity, and a discharge valve plate and a valve baffle are arranged at the first lower partition plate port.

2. The rotating cylinder enthalpy-adding piston compressor according to claim 1, wherein, the enthalpy-adding assembly comprises an enthalpy-adding component provided outside the compressor and an enthalpy-adding pipeline configured to connect the enthalpy-adding component to an interior of the compressor.

3. The rotating cylinder enthalpy-adding piston compressor according to claim 1, wherein, the lower partition plate is provided with a refrigerant entry passage and a gas supplying passage; and the enthalpy-adding pipeline communicates with the gas supplying passage by means of the lower partition plate gas supplying port.

4. The rotating cylinder enthalpy-adding piston compressor according to claim 3, wherein, the first-stage cylinder gas-intake cavity communicates with the refrigerant entry passage; and the first intermediate cavity communicates with the gas supplying passage and a discharge end of the first-stage rotating cylinder respectively.

5. The rotating cylinder enthalpy-adding piston compressor according to claim 1, wherein one side of the upper partition plate is coupled with the second-stage rotating cylinder, the second piston and the second cylinder liner; another side of the upper partition plate is coupled with the lower partition plate; the lower partition plate is further provided with the upper partition plate gas-intake port with a certain angle, which communicates with the lower cylinder gas-intake cavity defined in the lower partition plate and is disposed at a position corresponding to a gas-intake position of the second-stage rotating cylinder.

6. The rotating cylinder enthalpy-adding piston compressor according to claim 1, wherein the discharge valve plate and the valve baffle are fixed in a groove adjacent to the first lower partition plate port with a valve screw, and the discharge valve plate exactly covers the discharge port.

7. A rotating cylinder enthalpy-adding piston compressor, comprising:

a two-stage rotating cylinder piston compressor, comprising:

a first-stage rotating cylinder;

a first cylinder liner;

a first piston;

a second-stage rotating cylinder;

a second cylinder liner;

a second piston;

a lower flange;

an enthalpy-adding assembly, which is connected between the first-stage rotating cylinder and the second-stage rotating cylinder, and which is configured to supply gas and add enthalpy between two stages of rotating cylinders; and an upper partition plate and a lower partition plate arranged between the first cylinder liner and the second cylinder liner; wherein a gas-intake port is further provided radially in the lower flange, and a diameter of an outer circle of the gas-intake port is identical with an inner diameter of a casing; coupled with the lower cylinder, an end surface of the lower flange is provided with a sunk groove of the gas-intake port, which communicates with the gas-intake port provided radially;

a concavity with a certain shape is disposed between an inner orifice and an outer circle of the lower partition plate, and is coupled with the upper partition plate to form a first intermediate cavity; a lower partition plate gas supplying port is radially opened to an outer circle and communicates with the first intermediate cavity; an end surface of the lower partition plate is provided with a groove, which is a discharge groove; a first lower partition plate port is disposed adjacent to the discharge groove and is arranged corresponding a discharge position of the lower cylinder cavity; a discharge valve plate and a valve baffle are arranged at the first lower partition plate port.

8. The rotating cylinder enthalpy-adding piston compressor according to claim 7, wherein the enthalpy-adding assembly comprises an enthalpy-adding component provided outside the compressor and an enthalpy-adding pipeline configured to connect the enthalpy-adding component to an interior of the compressor.

9. The rotating cylinder enthalpy-adding piston compressor according to claim 7, wherein, the lower partition plate is provided with a gas supplying passage; the enthalpy-adding pipeline communicates with the gas supplying passage; the compressor further comprises a lower flange, and a refrigerant entry passage is disposed in the lower flange.

10. The rotating cylinder enthalpy-adding piston compressor according to claim 7, wherein, the refrigerant entry passage communicates with a gas entry end of the first-stage rotating cylinder; and the first intermediate cavity communicates with the gas supplying passage and a discharge end of the first-stage rotating cylinder respectively.

11. A rotating cylinder enthalpy-adding piston compressor, comprising: a two-stage rotating cylinder piston compressor, comprising:

a first-stage rotating cylinder; a first cylinder liner; a first piston;

a second-stage rotating cylinder; a second cylinder liner; a second piston;

an enthalpy-adding assembly, which is connected between the first-stage rotating cylinder and the second-stage rotating cylinder, and which is configured to supply gas and add enthalpy between two stages of rotating cylinders;

an intermediate partition plate arranged between the first cylinder liner and the second cylinder liner;

an upper flange; a lower flange; and a lower cover plate; wherein coupled with the second-stage rotating cylinder, an end surface of the upper flange is provided with two sunk grooves, which are an upper flange gas-intake port and a flow passage respectively; an opening is disposed radially in the upper flange; the opening is configured to be an upper flange gas supplying port which communicates with the upper flange gas-intake port and the flow passage;

a gas-intake port is further provided radially in the lower flange, and a diameter of an outer circle of the gas-intake port is identical with an inner diameter of a casing; coupled with the first-stage rotating cylinder, an end surface of the lower flange is provided with a sunk groove of the gas-intake port and a sunk groove of the lower flange discharge port; the sunk groove of the gas-intake port communicates with the gas-intake port provided radially; a discharge port is disposed adjacent to the sunk groove of a lower flange discharge port; an upper end surface of the lower flange is provided with a sunk concavity, which communicates with the discharge port, and a second intermediate cavity is formed between the sunk concavity and the lower cover plate; an edge of the second intermediate cavity is provided with a kidney-shaped port, which is a gas flow passage of the second intermediate cavity and communicates with a flow passage of the first cylinder liner, a flow passage of the intermediate partition plate and a flow passage of the second cylinder liner.

12. The rotating cylinder enthalpy-adding piston compressor according to claim 11, wherein a refrigerant entry passage is disposed in the lower flange; a gas supplying passage is provided in the upper flange; and an enthalpy-adding pipeline communicates with the gas supplying passage.

13. The rotating cylinder enthalpy-adding piston compressor according to claim 12, wherein the refrigerant entry passage communicates with a gas entry end of the first-stage rotating cylinder; the first cylinder liner communicates with the second cylinder liner and the intermediate partition plate to form a flow passage; one end of the flow passage communicates with the second intermediate cavity, and another end of the flow passage communicates with the gas supplying passage in the upper flange.

* * * * *